US005340193A

United States Patent [19]

Wolf

[11] Patent Number: 5,340,193

[45] Date of Patent: Aug. 23, 1994

[54] FOLDABLE DUAL SEAT

[76] Inventor: Henry W. Wolf, 649 Xenon Ct., Lakewood, Colo. 80228

[21] Appl. No.: 118,446

[22] Filed: Sep. 8, 1993

Related U.S. Application Data

[63] Continuation-in-part of Ser. No. 751,688, Aug. 29, 1991, Pat. No. D. 343,959.

[51] Int. Cl.[5] ..... A47C 4/42; A47C 9/10

[52] U.S. Cl. ..... 297/232; 297/45; 297/188; 297/244

[58] Field of Search ..... 297/42, 45, 188, 232, 297/244, 245, 246

[56] References Cited

U.S. PATENT DOCUMENTS

| | | | |
|---|---|---|---|
| 1,858,254 | 5/1932 | Uline | 297/248 X |
| 3,492,046 | 1/1970 | Wittner et al. | 297/45 X |
| 4,103,965 | 8/1978 | Engman . | |
| 4,687,248 | 8/1987 | Ross et al. . | |
| 4,736,825 | 4/1988 | Belfi . | |
| 4,834,415 | 5/1989 | Yee . | |
| 4,886,229 | 12/1989 | Aripze-Gilmore . | |

FOREIGN PATENT DOCUMENTS

| | | | |
|---|---|---|---|
| 25013 | of 1896 | United Kingdom | 297/45 |
| 403387 | 12/1933 | United Kingdom | 297/45 |

*Primary Examiner*—Peter R. Brown

*Attorney, Agent, or Firm*—Dorr, Carson, Sloan & Peterson

[57] ABSTRACT

A foldable portable chair provides users with two side-by-side seats. The supporting framework of the chair includes four support members. The first and second support members are hingeably attached to each other at their upper ends to forman inverted V-shape. The third and fourth support members are hingeably attached to each other at their lower ends to form a V-shape. The first and third support members and the second and fourth support members are then pivotally attached to each other so as to fold in a scissors fashion. A first seat member extends between the first support member and the third support member. A second seat member extends between the second support member and the fourth support member. In the preferred embodiment, the support members are U-shaped, and a storage compartment is suspended between the two seat members.

15 Claims, 6 Drawing Sheets 70
26
40
50
42
22
16
52
62
46
36
56
44
28
32
12
80
20
24
60
48
54
18
30
34
14
38
10

70
26
40
42
22
46
36
16
50
32
12
56
52
54
24
20
28
48
44
18
30
34
14
38
10

Fig. 5
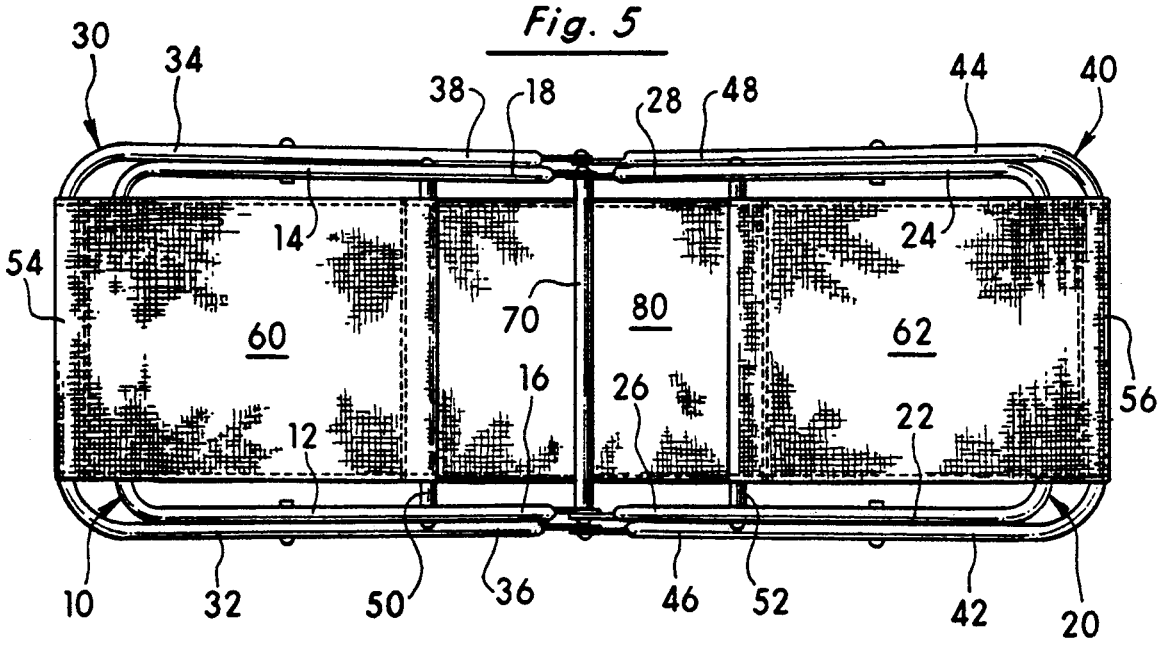
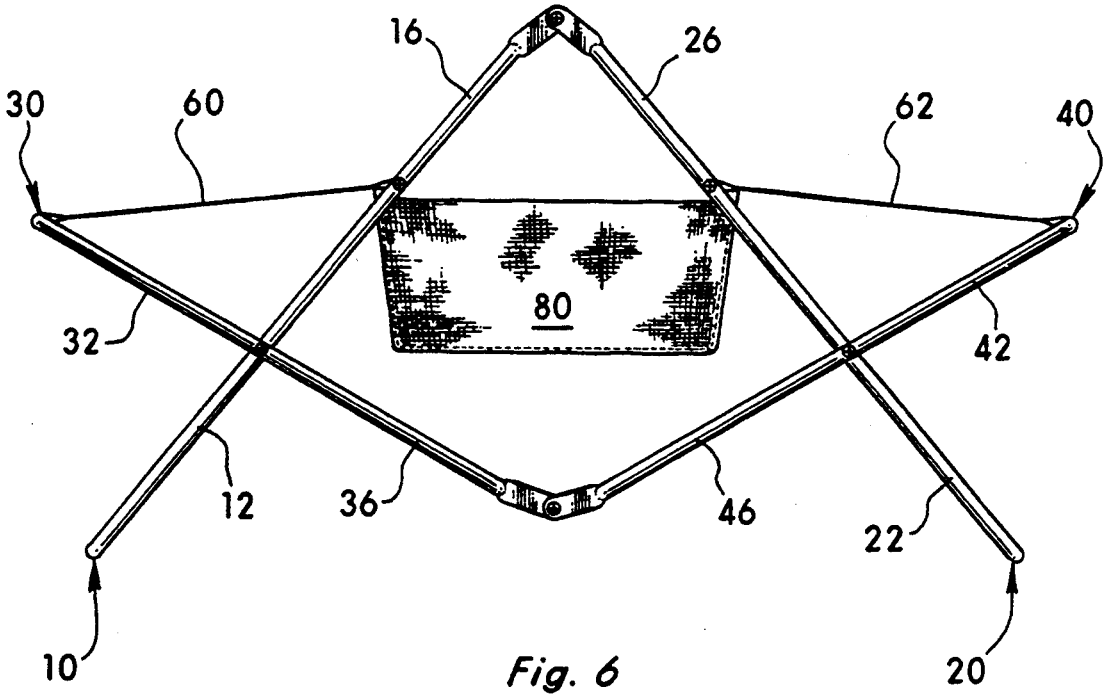
Fig. 6

Fig. 8
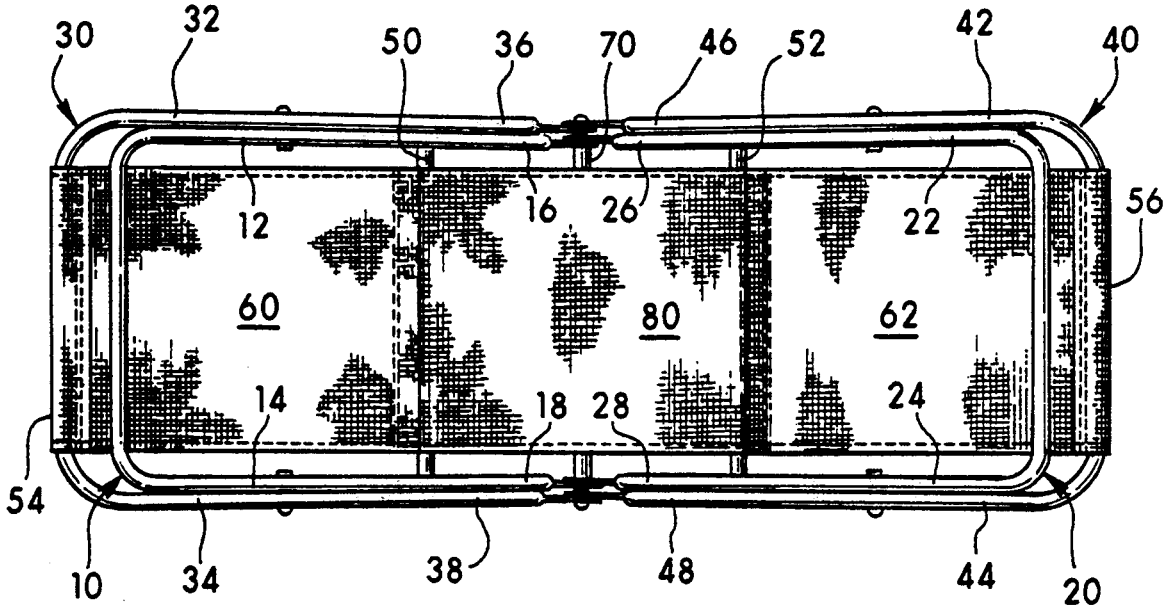
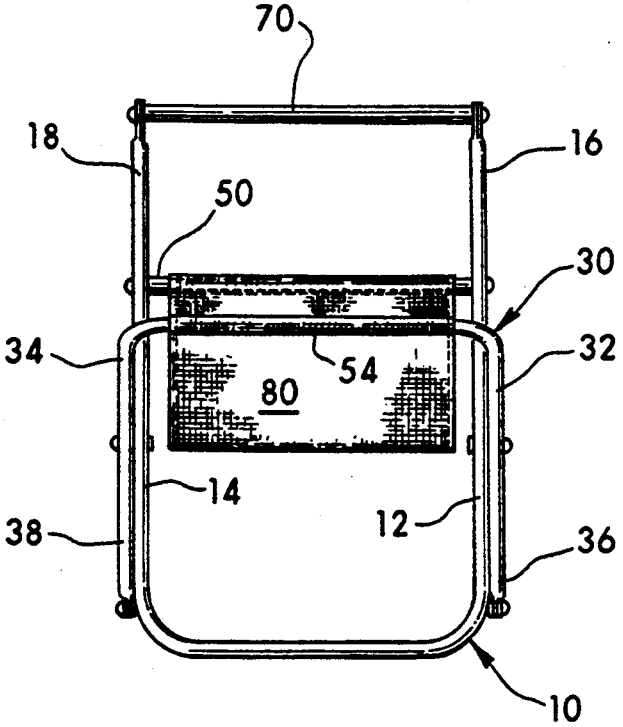
Fig. 9

FOLDABLE DUAL SEAT

BACKGROUND OF THE INVENTION

1. Related Application.

This patent application is a continuation-in-part of the applicant's co-pending U.S. Design Patent Application Ser. No. 07/751,688 filed Aug. 29, 1991, issued as U.S. Pat. No. 343,059 on Feb. 8, 1994 entitled "Foldable Dual Seat."

2. Field of the Invention

The present invention relates generally to the field of foldable seats. More specifically, the present invention discloses an easily portable foldable seat that provides seats for more than one user and also provides a storage compartment.

3. Statement of the Problem

From ancient times man has found it useful to have a simplified seat to sit upon, especially for brief periods, and long ago he discovered the advantages of portability of such a piece of furniture. A seat which could be folded into a compact size and shape, while also sufficiently strong and serviceable, became the object of numerous inventions.

Many variations of foldable seats have been developed over the years. Such seats are used for such diverse activities as camping, fishing, hunting, and hiking, by artists painting in the field, and by spectators at sporting events, concerts, golf tournaments, and parades. In such and similar uses, a compact folded size and shape, reasonably light weight, portability, and reasonably attractive appearance are important considerations, along with comfortable sitting.

Probably the simplest form of foldable seat and the oldest is the familiar camp stool whose frame and support members form an inverted U-shape. Two such U-shaped parts are pivotally connected at approximately the middles of their vertical sides, allowing the two parts to open into an X-shape, with an attached flexible seat stretching across the top of the X. When folded, the two U-shaped parts close against each other scissors fashion, with the flexible seat folded or tucked in between the folded frame parts.

Functionally, this design derives from the X-shaped supports used in chair design for centuries in many different countries and cultures. Hence, this design and its contemporary adaptations are of ancient heritage.

A number of foldable seats with X-shaped or other types of frames and having storage capacity have been invented in the past, including the following:

| Inventor | Patent No. | Issue Date |
|---|---|---|
| Engman | 4,103,965 | Aug. 1, 1978 |
| Aripze-Gilmore | 4,886,229 | Dec. 12, 1989 |
| Ross et al. | 4,687,248 | Aug. 18, 1987 |
| Belfi | 4,736,825 | Apr. 12, 1988 |
| Yee | 4,834,415 | May 30, 1989 |

For example, the 1978 patent to Engman and the 1989 patent to Aripze-Gilmore disclose a simple X-shaped stool having an attached storage compartment, for instance, a tackle box as disclosed in Engman.

Another type of foldable seat is disclosed in the 1987 patent to Ross et al. This foldable seat is a lounge or chair that when folded can be used as a tote bag.

A third type of foldable seat, disclosed in Belfi, is a collapsible A-frame tote bag that when unfolded acts as a back rest with an attached seating pad.

The 1989 patent to Yee sets forth a foldable baby cart with dual seats. A foot receiver is suspended between and below the seats.

There are shortcomings associated with these designs. Only the Yee seat is designed to be used by more than one user, but the Yee seat is not designed to be used by older children or adults, nor is it easily portable by one person when folded. The patents of Engman, Aripze-Gilmore, Ross et al., and Belfi disclose seats providing seating for only a single user. Each user must carry his own seat or have it carried for him as in Yee. Often when the seat is unfolded a storage compartment either does not exist, as in Ross et al., or is not easily accessible by the user, as in Belfi. Some prior seats do not have legs, as in Belfi, or have only very short legs, as in Ross et al. It is especially desirable for outdoor spectator events such as concerts and sporting events to have an easily portable, compact, foldable seat that provides comfortable seats for more than one child or adult user at a normal viewing height and also provides an easily accessible storage compartment for items wanted at such events, such as food and drink, sunglasses, binoculars, cameras, and radios.

4. Solution to the Problem

None of the prior art references uncovered in the search show a foldable seat with dual seats suitable for both child and adult users. The present invention provides a foldable dual seat having dual seats suitable for both child and adult users and having a convenient storage compartment. The storage compartment is placed between the seats and is easily accessible to the users. The present invention is easily portable when folded.

SUMMARY OF THE INVENTION

This invention provides a foldable seat having four support members. The first support member is hingeably attached to the second support member at or near their upper ends so that the combination forms an inverted V-shape. The third support member is hingeably attached to the fourth support member at or near their lower ends so that the combination forms a V-shape. The third support member is pivotally attached to the first support member so that these two support members open and close in a scissors fashion, The fourth support member is similarly pivotally attached to the second support member. A first seat member extends between the first support member and the third support member. A second seat member extends between the second support member and the fourth support member. A storage compartment is suspended between the two seat members.

The two seat members and the storage compartment in the preferred embodiment are composed of a single piece of fabric, such as canvas, that is attached to four transverse members associated with each support member by being looped around them and then stitched or otherwise attached to itself. The fabric is stretched between the first and third transverse members and between the second and fourth transverse members to form the two respective seat members. An excess of fabric between the first and second transverse members forms the storage compartment. A handle extends between the upper ends of the first and second support members.

A primary object of the present invention is to provide a foldable seat having more than one seat.

Another object of the present invention is to provide a seat that is compact and easily portable in a folded position.

Another object of the present invention is to provide a storage compartment that is easily accessible when the present invention is in an open position.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 5 is a top plan view of the foldable dual seat in the open position.

FIG. 6 is a front elevational view of the foldable dual seat in the open position.

FIG. 8 is a bottom plan view of the foldable dual seat in the open position.

FIG. 9 is a side elevational view of the foldable dual seat in the open position.

DETAILED DESCRIPTION OF THE INVENTION

Figure 1:
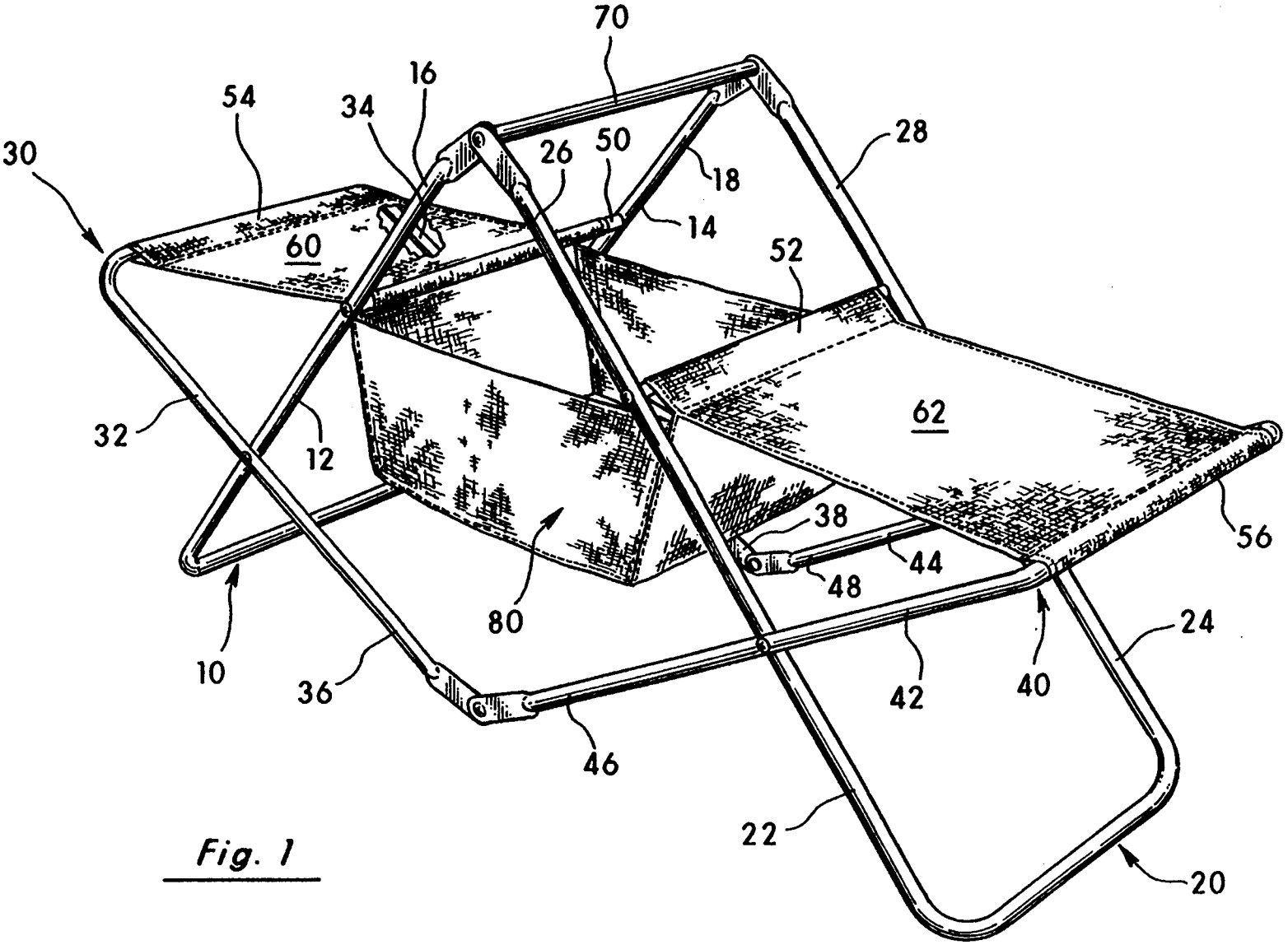
FIG. 1 is a perspective view of the foldable dual seat in the open position.
Figure 3:
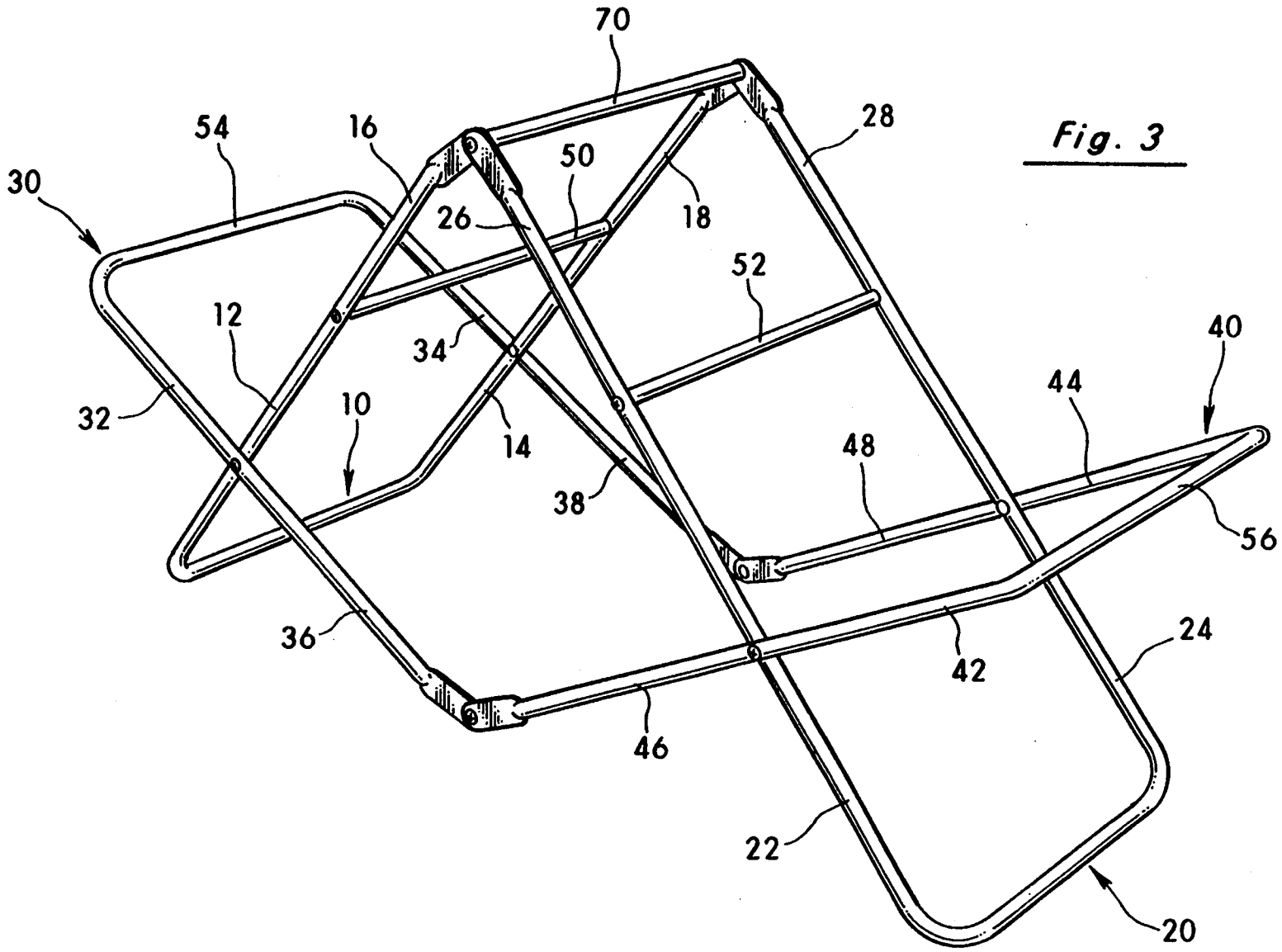
FIG. 3 is a perspective view of the frame of the foldable dual seat in the open position.
Figure 7:
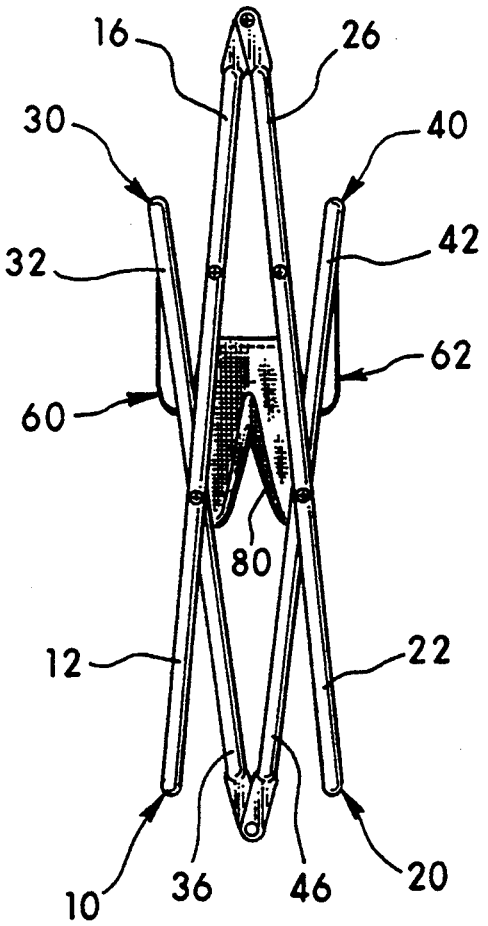
FIG. 7 is a front elevational view of the foldable dual seat in the folded position.

Turning to FIGS. 1 and 3, a first support member 10 is hingeably attached near its upper ends 16, 18 to the upper ends 26, 28 of a second support member 20. A third support member 30 is hingeably attached near its lower ends 36, 38 to the lower ends 46, 48 of a fourth support member 40. The third support member 30 is pivotally attached to the first support member 10. The fourth support member 40 is pivotally attached to the second support member 20.

The first and second support members 10, 20 form an inverted V-shape, and the third and fourth support members 30, 40 form a V-shape. The arms 12, 14 of the first support member 10 are pivotally attached to the corresponding arms 32, 34 of the third support member 30 so the two support members 10, 30 open and close in a scissors fashion as shown in FIGS. 1 and 2, 3 and 4, and 6 and 7. The arms 22, 24 of the second support member 20 are similarly pivotally attached to the corresponding arms 42, 44 of the fourth support member 40 so that these two support members 20, 40 also open and close in a scissors fashion as shown in FIGS. 1 and 2, 3 and 4, and 6 and 7.

Figure 2:
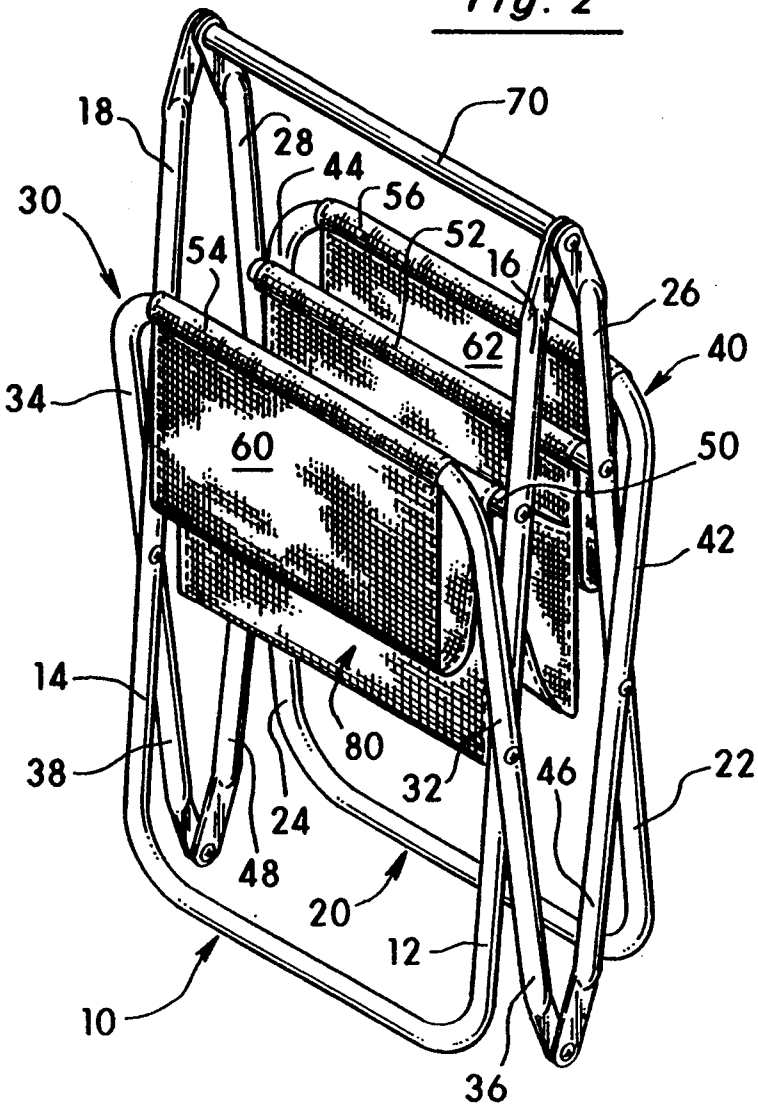
FIG. 2 is a perspective view of the foldable dual seat in the folded position.
Figure 4:
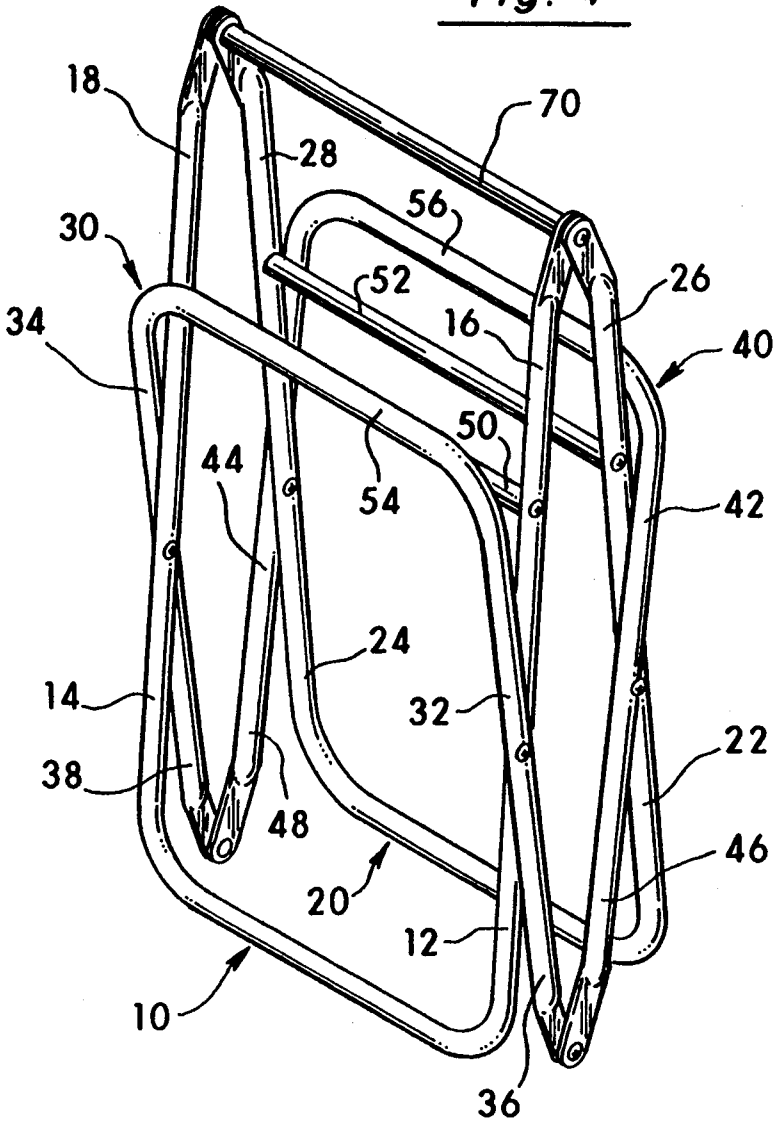
FIG. 4 is a perspective view of the frame of the foldable dual seat in the closed position.

As FIG. 1 illustrates, a first seat member 60 extends between the first support member 10 and the third support member 30. A second seat member 62 extends between the second support member 20 and the fourth support member 40. FIG. 2 shows the first and second seat members 60, 62 in the folded position. FIG. 5 shows a top plan view of the two seat members 60, 62 in the open position. FIG. 8 shows a bottom view and FIG. 9 shows a side elevational view of the foldable seat in the open position.

In the preferred embodiment, the four support members 10, 20, 30, 40 are generally U-shaped and manufactured from tubular metal or wood bars. Each support member has a base and two arms. The four support members 10, 20, 30, 40 could also be generally H-shaped. Alternatively, the first and second support members 10, 20 could be manufactured from a solid sheet of a sturdy material, for example, metal, wood, or plastic.

If the first and second support members 10, 20 are solid sheets, the arms 32, 34 of the third support member 30 are pivotally attached to the edges of the first support member 10, and the arms 42, 44 of the fourth support member are pivotally attached to the edges of the second support member 20. The arms of the four support members 10, 20, 30, 40, or the edges and arms when the first and second support members 10, 20 are solid sheets, are in a substantially parallel adjacent relationship with each other when in a folded position and are angularly positioned relative to each other and to a supporting surface when unfolded. It is to be expressly understood that the above description does not constitute the sole manner in which the seat could be folded and unfolded. The above description is the preferred embodiment, and other embodiments are contained in the scope of the invention.

In the preferred embodiment, a first transverse member 50 extends between the arms 12, 14 of the first support member 10. A second transverse member 52 extends between the arms 22, 24 of the second support member 20. A third transverse member 54 extends between the arms 32, 34 of the third support member 30. A fourth transverse member 56 extends between the arms 42, 44 of the fourth support member 40. The third and fourth transverse members 54, 56 preferably form the bases of the suggested U-shaped third and fourth support members 30, 40. In the H-shaped configuration, the four transverse members 50, 52, 54, 56 would form the cross-bars of the H. The transverse members 50, 52, 54, 56 are preferably manufactured from tubular metal or wood bars. The transverse members 50, 52, 54, 56 are preferably parallel to each other and to the supporting surface and are preferably perpendicular to the four support members 10, 20, 30, 40.

As shown in FIGS. 1 and 6, the first seat member 60 is suspended between the third transverse member 54 and the first transverse member 50. The second seat member 62 is suspended between the fourth transverse member 56 and the second transverse member 52. These two seat members 60, 62 are manufactured from fabric, such as canvas. The two seat members 60, 62 alternatively are manufactured from any sturdy lightweight material that enables the seats to fold when the chair is folded. When the first and second support members 10, 20 are solid sheets, the first and second seat members 60, 62 are attached directly to the first and second support members 10, 20, for example, by being bolted or stapled directly to the solid sheets or by having portions thereof passed through holes or slits in the first and second support members 10, 20 and attached in any secure manner obvious to one skilled in the art.

FIGS. 1 and 6 show a storage compartment 80 suspended between the first seat member 60 and the second seat member 62. The storage compartment 80 is preferably suspended between the first transverse member 50 and the second transverse member 52. The storage compartment 80 is manufactured from fabric, such as canvas. However, the storage compartment 80 could be manufactured from any suitable material, for example, nylon mesh, that allows the storage compartment 80 to fold when the seat is folded and allows access to the storage compartment 80 by the user. It is also to be expressly understood that the storage compartment could be located in another position, for example, suspended from the handle 70 or placed under a seat member, that allows access by a user of the seat.

The first seat member 60, the second seat member 62, and the storage compartment 80 can be made of a single piece of fabric, such as canvas. The single piece of fabric is preferably rectangular. One end of the single piece of fabric is looped around the third transverse member 54 and fastened to itself by stitching or by any other suitable method of fastening, for example, stapling or gluing. Alternatively, the end of the fabric could be attached directly to the third transverse member 54. Another end of the single piece of fabric is similarly looped around the fourth transverse member 56 and fastened to itself by stitching or by any other suitable method of fastening, for example, stapling or gluing, or fastened directly to the fourth transverse member 56. A middle portion of the single piece of fabric is looped around both the first transverse member 50 and the second transverse member 52 and fastened to itself by stitching both loops or by any other suitable method of fastening, for example, stapling or gluing. An excess of fabric suspended between the first transverse member 50 and the second transverse member 52 forms the storage compartment 80. It is to be expressly understood that the above description does not constitute the sole manner in which the two seat members and the storage compartment could be made and attached to the frame of the foldable seat. The above description is the preferred embodiment, and other embodiments will be obvious to those skilled in the art.

FIGS. 1 and 2 show a handle 70 extending between the upper ends 16, 18 of the first support member 10 and between the upper ends 26, 28 of the second support member 20. The handle 70 is preferably manufactured from a straight piece of tubular metal or wood. Alternatively, the handle 70 could be made from any material or have any shape, e.g., arcuate, that would enable a user to conveniently carry the foldable seat in its folded position. For example, a fabric strap could be attached permanently or detachably to the upper ends 16, 18, 26, 28 of the first and second support members 10, 20 or to any other suitable part of the frame of the foldable seat that would allow the user to carry the foldable seat by hand or by slinging the strap over a shoulder.

The above disclosure sets forth a number of embodiments of the present invention. Other arrangements or embodiments, not precisely set forth, could be practiced under the teachings of the present invention and as set forth in the following claims.

I claim:

1. A foldable seat comprising:

(a) a first support member having an upper end;

(b) a second support member having an upper end, said second support member hingeably attached to said first support member near said upper ends;

(c) a third support member having a lower end, said third support member pivotally attached to said first support member;

(d) a fourth support member having a lower end, said fourth support member hingeably attached to said third support member near said lower ends and pivotally attached to said second support member;

(e) a first seat member extending between said first support member and ad third support member, (f) a second seat member extending between said second support member and said fourth support member; and (g) a storage compartment suspended between said first and said second seat members.

2. The foldable seat of claim 1, wherein said first and said second support members further comprise a handle attached near said upper ends.

3. The foldable set of claim 1, wherein said first and said second seat members are comprised of fabric.

4. The foldable seat of claim 1, wherein said seat members and said storage compartment are comprised of a single piece of fabric.

5. A foldable seat comprising:

(a) a first support member having an upper end, a lower end, and a first transverse member extending across said first support member;

(b) a second support member having an upper end and a lower end, said first support member hingeably attached to said second support member at said respective upper ends, said second support member further having a second transverse member extending across said second support member;

(c) a third support member having an upper end and a lower end, said third support member pivotally attached to said first support member between said respective upper ends and lower ends, said third support member further having a third transverse member extending across said third support member near said upper end;

(d) a fourth support member having an upper end and a lower end, said third support member hingeably attached to said fourth support member at said respective lower ends, said fourth support member pivotally attached to said second support member between said respective upper ends and lower ends, said fourth support member further having a fourth transverse member extending across said fourth support member near said upper end;

(e) a first seat member extending between said first transverse member and said third transverse member;

(f) a second seat member extending between said second transverse member and said fourth transverse member; and (g) a storage compartment suspended between said first and said second seat members.

6. The foldable seat of claim 5, wherein said first and said second support members further comprise a handle attached near said upper ends.

7. The foldable seat of claim 5, wherein said first and said second seat members are comprises of fabric.

8. The foldable seat of claim 5, wherein said seat members and said storage compartment are comprises of a single piece of fabric.

9. A foldable seat comprising:

(a) a first U-shaped member having two arms with upper ends;

(b) a first transverse member extending between said arms of said first U-shaped member and providing an additional cross member which is spaced from the lower cross member of the U-shape;

(c) a second U-shaped member having two arms with upper ends, said upper ends being hingeably attached to said upper ends of said arms of said first U-shaped member;

(d) a second transverse member extending between said arms of said second U-shaped member and providing an additional cross member which is spaced from the lower cross member of the U-shape;

(e) a third U-shaped member having two arms with lower ends, each arm being pivotally attached to a corresponding one of said arms of said first U-shaped member;

(f) a third transverse member extending between said arms of said third U-shaped member;

(g) a fourth U-shaped member having two arms with lower ends, each arm being pivotally attached to a corresponding one of said arms of said second U-shaped member, said lower ends begin hingeably attached to said lower ends of said arms of said third U-shaped member;

(h) a fourth transverse member extending between said arms of said fourth U-shaped member;

(i) a first seat member suspended between said first transverse member and said third transverse member;

(j) a second seat member suspended between said second transverse member and said fourth transverse member; and (k) a storage compartment suspended between said first and said second seat members.

10. The foldable seat of claim 9, wherein said first and said second U-shaped members further comprise a handle attached near said upper ends.

11. The foldable seat of claim 9, wherein said first and said second seat members are comprised of fabric.

12. The foldable seat of claim 9, wherein said storage compartment is further suspended between said first and said second transverse members.

13. The foldable seat of claim 9, wherein said seat members and said storage compartment are comprised of a single piece of fabric.

14. The foldable seat of claim 13, wherein said single piece of fabric has a first end looped around said third transverse member and attached to itself, a second end looped around said fourth transverse member and attached to itself, and a middle looped around both said first transverse member and said second transverse member and attached to itself at both said loops.

15. The foldable seat of claim 14, wherein said single piece of fabric comprises an excess of fabric between said first and said second transverse members to form said storage compartment.

* * * * *